United States Patent [19]

Higashiguchi

[11] 4,292,100

[45] Sep. 29, 1981

[54] METHOD FOR PREPARING FLOCK TRANSFER INCLUDING DRYING RELEASE ADHESIVE PRIOR TO APPLYING FLOCK

[76] Inventor: Shigehiko Higashiguchi, 3 -4- 2 Honjo, Sumida-Ku, Tokyo, Japan

[21] Appl. No.: 65,187

[22] Filed: Aug. 9, 1979

[51] Int. Cl.[3] ..... B44C 3/02

[52] U.S. Cl. ..... 156/72; 156/230; 156/234; 156/239; 156/240; 156/276; 156/277; 156/280; 156/283; 427/197; 427/200; 427/202; 427/206; 428/90; 428/914

[58] Field of Search ..... 428/90, 914; 156/72, 156/230, 234, 239, 240, 276, 277, 280, 283; 427/197, 200, 202, 206

[56] References Cited

U.S. PATENT DOCUMENTS

| | | | |
|---|---|---|---|
| 3,379,604 | 4/1968 | Weber | 428/90 |
| 3,956,552 | 5/1976 | Geary | 428/90 |
| 4,142,929 | 3/1979 | Otomine | 428/914 |

*Primary Examiner*—Marion McCamish

*Attorney, Agent, or Firm*—Pearne, Gordon, Sessions, McCoy & Granger

[57] ABSTRACT

A transferable flocked fiber design or sticker material which comprises a releasably flocked fiber base including fibers releasably flocked at one end to one major surface of a release support base sheet in upright position by means of a release adhesive layer; and a thermoplastic and pressure-sensitive synthetic resin layer applied to the other end of the flocked fibers. The entire area of the fiber-flocked surface of the release support base sheet is colored or printed or a selected area of the surface is colored or printed in a desired design or pattern and hot melt resin in the form of particles or pellets is sprinkled over the colored or printed surface of the release support base sheet. A method for preparing the releasably flocked fiber base in which a release adhesive layer is formed on one major surface of a release support base sheet, fibers are releasably flocked to the adhesive-applied surface of the release support base sheet and the adhesive-applied surface is colored or printed.

3 Claims, 5 Drawing Figures

METHOD FOR PREPARING FLOCK TRANSFER INCLUDING DRYING RELEASE ADHESIVE PRIOR TO APPLYING FLOCK

BACKGROUND OF THE INVENTION

This invention relates to a transferable flocked fiber design or sticker material and a method for preparing the transferable flocked fiber design or sticker material and more particularly, to a releasably flocked fiber base for the transferable flocked fiber design or sticker material and a method for preparing the releasably flocked fiber base.

There have been proposed and practically employed a variety of transferable flocked fiber design or sticker materials. Most of the releasably flocked fiber bases of the prior art transferable flocked fiber design or sticker materials have been prepared by a method which substantially comprises the steps of applying a release adhesive in a molten state to one major surface of a release support base sheet to form a release adhesive layer thereon, of releasably flocking a number of fibers to the adhesive-applied surface of the release support base sheet in substantially upright position by electrostatic action and drying the assembly to firmly hold the fibers in position to thereby provide a releasably flocked fiber base. However, the releasably flocked fiber base for a transferable flocked fiber design or sticker material prepared by the above-mentioned method has presented the following two undesirable phenomena.

The first undesirable phenomenon is that when fibers 3 are releasably flocked at one end or the base end 3*a* to the release adhesive layer 2 applied to one major surface of the release support base sheet 1, some of the fibers 3 tend to incline with respect to the vertical or fall down rather than extending in substantially upright position as seen in the cross-sectional view of FIG. 1.

Through extensive experiments, it has been found that this phenomenon is due to the fact that since the fibers are flocked to the adhesive layer-applied surface of the release support base 1 while the material of the adhesive layer 2 is still in its molten state, when the assembly is dried the inclined and fallen-down fibers are releasably secured to the adhesive layer in these non-upright positions.

The second undesirable phenomenon is that as clear from the cross-sectional view of FIG. 2 which shows the releasably flocked fiber base of FIG. 1 on a further enlarged scale, the base ends 3*a* of the flocked fibers 3 are embedded in the solidified release adhesive layer 2 in a rather great depth and surrounded by rising portions of the adhesive material.

The phenomonon is due to the facts that since the fibers 3 are electrostatically flocked to the release adhesive-applied surface of the support base sheet 1 while the material of the release adhesive layer 2 is still in the molten state, the base ends 3*a* of the fibers 3 invade into the adhesive layer 2 by a rather great depth and that when the fibers are flocked to the release support base sheet while the material of the release adhesive layer 2 is still in the molten state, the material of the adhesive layer rises up or builds up along the base ends 3*a* of the fibers 3 by the so-called capillarity to form surrounding curtains about the fiber base ends.

Thus, in order to provide a transferable flocked fiber design or sticker material having the releasably flocked fiber base produced by the prior art method described hereinabove, when a thermoplastic and pressure sensitive synthetic resin layer 4 is applied to the exposed ends of the releasably flocked fibers 3 and the thus obtained transferable flocked fiber design or sticker material is then applied to an article to be decorated with the design material such as a shirt S, there are at least the following three disadvantages.

First, even when the thermoplastic and pressure-sensitive synthetic resin layer 4 is formed at the free ends of the flocked fibers 3 of the releasably flocked fiber base, since the flocked fibers 3 extend above the release adhesive layer 2 by different distances, the free ends of the flocked fibers 3 do not lie in the same horizontal plane. This means that the free ends of some of the flocked fibers 3 do not reach are not adhered to the synthetic resin layer 4 (see FIGS. 1 and 2).

Thus, when the fibers 3 are transferred onto an article to be decorated such as a shirt S by employing the transferable flocked fiber design material or sticker A having the releasably flocked fiber base as described hereinabove incorporated therein, even if the thermoplastic and pressure-sensitive layer 4 is applied against the shirt and melted under heating and pressurization conditions so as to cause a portion of the material of the synthetic resin layer 4 to penetrate into the openings between the threads of the shirt S, the ends of some of the fibers may fail to reach the molten penetrating portion of the material of the synthetic resin layer 4. As a result, the fibers which do not reach the penetrating portion of the material of the synthetic resin layer 4 will not be transferred onto the shirt S and in an extreme case, the fibers are sparsely transferred onto the shirt S to provide an incomplete fiber transfer pattern (see FIG. 3).

Second, when the releasably flocked fiber base is coloured or printed in a desired design or pattern by means of the conventional screen printing or the like, the base ends 3*a* of the flocked fibers 3 are embedded deeply in the solidified release adhesive layer 2 because of the capillarity mentioned hereinabove in connection with the second phenomenon and since the base ends 3*a* of the fibers 3 are surrounded by the rising portions of the material of the release adhesive layer 2, the printing ink is prevented from penetrating throughout the full length of the individual fibers whereby the flocked fibers 3 cannot be satisfactorily coloured or printed. Therefore, when the fiber transfer operation is performed by the employment of the transferble flocked fiber design or sticker material having the releasably flocked fiber base including such imcompletely coloured or printed flocked fibers, there is the possibility that the fibers which are spottily coloured or printed are transferred onto the shirt S.

Third, in the transfer of the releasably flocked fibers 3 from the transferable flocked fiber design or sticker material A onto the shirt S as mentioned hereinabove, the releasably flocked fibers 3 to be transferred onto the shirt in a desired or predetermined design or pattern has to be separated promptly and easily from the sticker material A.

However, since the base ends 3*a* of some of the releasably flocked fibers 3 of the releasably flocked fiber base in which the above-mentioned second phenomenon occurred are embedded deeply in the solidified release adhesive layer 2 or surrounded by rising portions of the material of the release adhesive layer, when the transferable flocked fiber material A is separated from shirt S in the fiber transfer operation so as to permanently transfer and retain the fibers 3 onto and on the shirt in a desired or predetermined design or pattern defined by the colouring or printing, such fibers are firmly retained on the solidified release adhesive layer 2 or on the thermoplastic and pressure-sensitive synthetic resin layer 4, such fibers 3 break off or are pulled up by the adhesive applied base sheet 1 without being transferred onto the shirt S in the separation operation to thereby provide a sparsely transferred fiber design or pattern. Furthermore, there is the possibility that a portion of the material of the release adhesive layer 2 itself remains to adhere to the transferred fibers 3 and is transferred onto the shirt S.

Any one of the prior art release adhesives employed in a molten state for releasably flocking the fibers to the release support base sheet maintains a loose paste state for a certain period of time after the application of the adhesive to the base sheet and the formation of the release adhesive layer thereon and thus, when the fiber transfer operation is performed while the adhesive layer is in the paste state, the fiber inclination, falling down and deep embedding referred to hereinabove would occur. And when the release adhesive is left as it is to allow it to dry after the application of the adhesive, the dried adhesive has lost its original viscosity or fiber flocking function.

SUMMARY OF THE INVENTION

Therefore, the present invention is to overcome the technical difficulties inherent in the prior arts referred to hereinabove.

One object of the present invention is to provide a transferble flocked fiber design or sticker material having fibers releasably flocked to a release support base sheet in substantially upright position and closely adjacent relationship to each other.

Another object of the present invention is to provide a transferable flocked fiber design or sticker material having fibers releasably flocked to a release support base sheet and capable of being coloured or printed throughout the entire length of the fibers.

Another object of the present invention is to provide a transferable flocked fiber design or sticker material having fibers releasably flocked to a release support base sheet to be transferred onto an article to be decorated with the design or sticker material in a desired design or pattern.

Another object of the present invention is to provide a method for preparing a releasably flocked fiber base for such a transferable flocked fiber design or sticker material.

Another object of the present invention is to make it possible to transfer fibers releasably flocked to a release support base sheet onto an article to be decorated with the design or sticker material in a finely defined configuration.

Another object of the present invention is to provide a method for preparing a releasably flocked fiber base for a transferable flocked fiber design or sticker material which is different from the prior art method for preparing the design or sticker material in which electrostatic fiber flocking is performed immediately after the formation of a release flocking adhesive layer in a liquid state on a release support base sheet by applying a release adhesive to the support base sheet.

In order to attain the above objects, according to the present invention, the flocked fiber base for the transferable flocked fiber design or sticker material is prepared by the use of improved steps and release adhesives different from those employed in the prior arts.

In the practice of the present invention, release adhesives useful for releasably flocking fibers to a release support base sheet include natural rubber, synthetic rubber, acrylic acid copolymer, polyethylene oxide, vinyl methyl ether—maleic acid anhydride copolymer, vinyl acetate and the like. Any one of these release adhesives can retain its viscosity even after the adhesive has been dried on the release support base sheet to which the adhesive is applied and materials used as the release support base sheet in the present invention include cloth, non-woven fabric, cellophane, synthetic resin film, sulfuric acid paper, kraft paper and the like which have been conventionally employed as transfer sheets.

Fibers useful as fibers to be flocked in the present invention include short fibers, fine glass particles and fine metal particles (in most cases, since fine short fibers are employed, they will be generally referred to as "fibers to be flocked" hereinafter).

According to the present invention, any one selected from the above-mentioned release adhesives is applied to one major surface of any one selected from the above-mentioned release support base sheet materials and the above-mentioned fibers are releasably flocked to the adhesive-applied surface of the release support base sheet to provide a releasably flocked fiber base. Thereafter, a colouring or printing is performed on the entire or at a selected area of the fiber-flocked surface of the release support base sheet in a desired design or pattern by means of a printing screen or the like, a thermoplastic and pressure-sensitive synthetic resin is applied to the coloured or printed surface or surface area of the release support base sheet to form a layer of such resin thereon and hot melt resin in the form of particles or pellets is then sprinkled over the synthetic resin layer to provide a complete transferable flocked fiber design or sticker material.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any.

PREFERRED EMBODIMENT OF THE INVENTION

Figure 4:
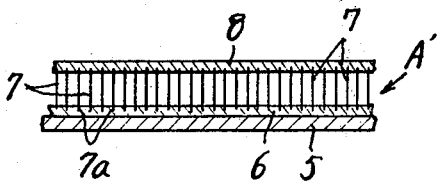
FIG. 4 is a cross-sectional view on an enlarged scale of a transferable flocked fiber design material having one embodiment of releasably flocked fiber base of the invention incorporated therein.
Figure 5:
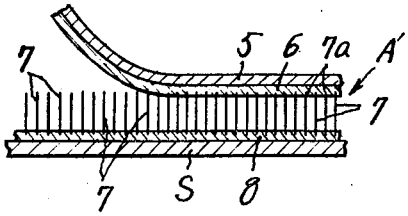
FIG. 5 is an explanative view on a further enlarged scale showing the manner in which the release support base sheet is separated from the releasably flocked fibers in the fiber transfer operation.

The present invention will be now described referring to the accompanying drawings and more particularly, to FIGS. 4 and 5 thereof in which a transferable flocked fiber design or sticker material having the releasably flocked fiber base embodying the present invention therein is shown.

According to the present invention, an adhesive selected from the above-mentioned various release adhesives in a liquid state is applied to one major surface of a release support base sheet 5 selected from the above-mentioned release support base sheet materials by a suitable conventional means and then dried by a suitable conventional means to thereby form a release adhesive layer 6 on the release support base sheet 5.

The thus formed release adhesive layer 6 is no longer in the liquid state as applied to the support base sheet 5, but still retains its original viscosity.

After the release adhesive layer 6 has been formed on the one major surface of the release support base sheet 5, a number of individual fibers 7 are releasably flocked to the adhesive applied surface of the support base sheet 5 by a conventional electrostatic flocking device. In the electrostatic flocking operation, since the fibers 7 are charged with static electrons and the release support base sheet 5 having the adhesive layer 6 formed thereon is disposed on the electrode side, the fibers 7 are driven into the adhesive layer 6 on the base sheet 5 at substantially right angles to the plane of the base sheet 5 whereby the fibers 7 are flocked to the adhesive layer 6 in substantially upright position. Since the release adhesive layer 6 has been solidified prior to the flocking of the fibers 7, one of the ends or the lower ends 7*a* of the fibers 7 (as seen in FIG. 4) will not pierce deeply into the adhesive layer 6, but terminate short of the layer side in contact with the base sheet 5.

Figure 1:
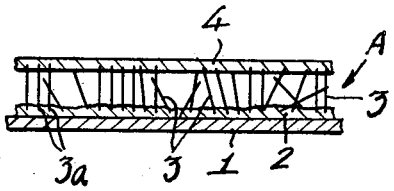
FIG. 1 is a cross-sectional view on an enlarged scale of one prior art transferable flocked fiber design or sticker material.
Figure 2:
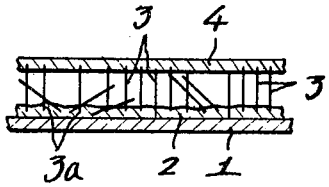
FIG. 2 is a cross-sectional view of a portion of the transferable flocked fiber design or sticker material as shown in FIG. 1 showing the releasably flocked fiber base thereof.
Figure 3:
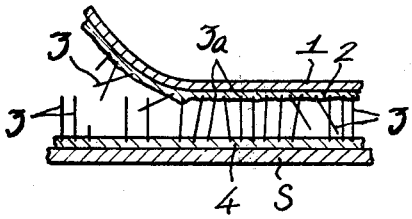
FIG. 3 is a cross-sectional view on an enlarged scale of another prior art transferable flocked fiber design or sticker material.

As mentioned hereinabove, since the release adhesive layer 6 has been solidified prior to the flocking of the fibers 7 thereto, in the fiber flocking operation, the adhesive layer 6 will not build up about the ends 7*a* of the flocked fibers 7 due to the capillarity which occurred inevitably in the prior art transferable flocked fiber design or sticker materials as shown in FIGS. 1 through 3. Thus, the flocked fibers 7 will not incline and/or fall down but will maintain their substantially upright position even after the flocking of the fibers.

Since the release adhesive layer 6 is formed of an adhesive which has been prepared so as to retain a certain viscosity sufficient to releasably hold the flocked fibers 7 on the release support base sheet 5 for a substantial time period, but insufficient to permanently hold the fibers 7 on the support base, the flocked fibers 7 can be held in the upright position on the release support base sheet 5 until the flocked fiber design material is practically employed onto an article and easily separated from the base sheet when the fibers are transferred onto an article to be decorated with the design or sticker material.

The fiber-flocked surface of the release support base sheet 5 is coloured or printed in a desired design pattern by means of a screen printing or the like means and the free ends of the flocked fibers 7 then have applied thereto a thermoplasic and pressure-sensitive synthetic resin layer 8 by a suitable conventional means. Hot melt resin in the form of particles or pellets is then sprinkled over the synthetic resin layer 8 and the thus obtained assembly is allowed to dry or forcibly dried to thereby obtained the complete flocked fiber design or sticker material A' as shown in FIG. 4. The thus obtained flocked fiber design or sticker material A' of the invention is quite different from the prior art flocked fiber design materials A of FIGS. 1 through 3.

One example for preparing the releasably flocked fiber base for a flocked fiber design or sticker material of the present invention will be given hereinbelow.

In this example, EXP 70 (trade name) which is one of acrylic acid copolymers and available by Dainihon Ink Co., Ltd. in Tokyo as the releasable adhesive is applied to one major surface of a sheet of composite paper to form the release adhesive layer 6 and 3 denier rayon piles each having the length of 0.5 mm as fibers to be flocked are releasably flocked to the adhesive-applied major surface of the base sheet 5.

The release adhesive is evenly applied to one major surface of the composite base paper sheet in the amount range of 30–30 g/m$^2$ and the adhesive-applied base paper sheet is heated at 80° C. for about 0.5–1 minute to dry the adhesive-applied paper sheet surface. Thereafter, the rayon piles are flocked to the adhesive-applied surface of the paper sheet in an electrostatic field of 20,000 volts.

In this way, the releasably flocked fiber base as shown in FIG. 4 is obtained and the releasably flocked fiber base has a desired high fiber distribution density and the fibers are flocked to the adhesive-applied surface of the base paper sheet in substantially upright position. The obtained releasably flocked fiber base is a quite satisfactory product which possesses all the requirements called for by the present invention referred to hereinabove.

Since the fibers 7 are flocked to the adhesive-applied surface of the release support base sheet 5 in substantially upright position, the fibers extend vertically above the adhesive-applied surface of the support sheet by a substantially uniform distance and the thermoplastic and pressure-sensitive synthetic resin can be applied to the free ends of the flocked fibers 7 in a substantially uniform layer to provide the transferable flocked fiber design or sticker material A'.

Thus, when the fibers releasably flocked to the adhesive-applied surface of the release support base sheet 5 in the thus obtained transferable flocked fiber design or sticker material A' are desired to be permanently transferred onto an article to be decorated with the design material such as a shirt S in a desired design pattern in the manner mentioned hereinabove, since the fibers 7 are uniformly transferred onto the shirt at the free ends thereof embedded in the thermoplastic and pressure-sensitive synthetic resin layer 8 applied to the free ends of the fibers 7 when the resin of the layer 8 melts by heat applied thereto, the disadvantages described hereinabove in connection with the prior art flocked fiber design or sticker materials can be effectively eliminated.

Furthermore, since the base ends 7*a* of the releasably flocked fibers 7 are embedded in the release adhesive layer 6 in a shallow depth and the building-up phenomenon of the adhesive about the base ends 7*a* of the fibers 7 do not occur, when the adhesive-applied surface of the base sheet 5 is colored or printed with a desired design or pattern, the coloring or printing ink can penetrate throughout each of the fibers 7 to one end to the other end thereof to thereby perform a finely detailed printing.

Therefore, when the flocked fibers 7 of the thus obtained transferable design or sticker material A' are transferred onto the article such as the shirt S, the second disadvantage described hereinabove in connection with the prior art transferable design or sticker materials can be effectively eliminated because the entire fibers are printed finely whereby the fibers are transferred onto the article in a finely coloured or printed design or pattern.

And as mentioned hereinabove, since the base ends 7*a* of the fibers 7 are embedded in the release adhesive layer 6 in a shallow depth, when the fibers 7 are transferred onto the article in the above-mentioned transfer operation, the fibers can be transferred onto the shirt eliminating the third disadvantage described in connection with the prior art transferable flocked fiber design or sticker material.

As clear from the foregoing description in connection with the preferred embodiment of the invention, according to the present invention, substantially all the fibers are releasably flocked to the support base sheet in substantially upright position and embedded in the release adhesive layer in a very shallow depth, the fiber-flocked surface of the support base sheet is coloured or printed in a desired design pattern and the thermoplastic and pressure-sensitive synthetic resin is applied to the entire area of the coloured or printed base surface or a portion of the coloured or printed base surface in a desired design to thereby provide the intended transferable flocked fiber design or sticker material. When the flocked fibers of the transferable flocked fiber design material are transferred onto the article to be decorated with the design material, the fibers can be satisfactorily transferred onto the article in an ideal design or pattern.

In use, the transferable flocked fiber design or sticker material is placed onto a shirt, for example, with the thermoplastic and pressure-sensitive synthetic resin layer in contact with the shirt and pressed against the shirt under heating and pressurizing conditions by the use of a domestic iron whereby the material of the synthetic resin layer melts and penetrates into the openings between the threads of the shirt. The molten resin material also flows about the ends of the flocked fibers to which the synthetic resin layer is applied.

The molten synthetic resin is allowed to cool and solidify in the open air and the solidified resin firmly secures the fibers to the shirt.

Thereafter, when the transferable flocked fiber design or sticker material is separated from the shirt, all the flocked fibers or those of the fibers to which the synthetic resin layer is applied in the desired design or pattern are separated from the release adhesive layer to leave the fibers to be firmly secured to the shirt whereby all the fibers or those of the fibers permanently are transferred onto the shirt in conformity with the contour of the synthetic resin layer.

While only one specific embodiment of the invention has been shown and described in detail, it will be understood that the same is for illustration purpose only and not to be taken as a definition of the invention, reference being had for this purpose to the appended claims.

What is claimed is:

1. A method for preparing a releasably flocked fiber base for a transferable flocked fiber design or sticker material comprising the steps of: applying a release adhesive in a liquid state to one major surface of a release support base sheet to form a release adhesive layer, said release adhesive being capable of retaining a viscous state for a predetermined period of time even after the application and drying of the adhesive, drying said release adhesive with the application of heat to obtain a still viscous adhesive layer, and releasably flocking a plurality of fibers at one of the ends thereof to said still-viscous adhesive layer of the base sheet in substantially upright position by electrostatic flocking means so as to embed said ends of the fibers in said still-viscous adhesive layer in a shallow depth.

2. The method as set forth in claim 1, wherein said release adhesive is an acrylic acid copolymer.

3. The method as set forth in claim 2, wherein said release adhesive has been dried for 0.5 to 1 minute at about 80° C. after application to the base sheet and prior to application of the flocked fibers.

* * * * *